US010532481B2

(12) United States Patent
Kundracik et al.

(10) Patent No.: US 10,532,481 B2
(45) Date of Patent: Jan. 14, 2020

(54) PUNCH TOOL SYSTEM

(71) Applicants: Richard M. Kundracik, Elyria, OH (US); Matthew Bertram, Elyria, OH (US); Robert M. Baracskai, Elyria, OH (US)

(72) Inventors: Richard M. Kundracik, Elyria, OH (US); Matthew Bertram, Elyria, OH (US); Robert M. Baracskai, Elyria, OH (US)

(73) Assignee: RIDGE TOOL COMPANY, Elyria, OH (US)

( * ) Notice: Subject to any disclaimer, the term of this patent is extended or adjusted under 35 U.S.C. 154(b) by 242 days.

(21) Appl. No.: 14/951,595

(22) Filed: Nov. 25, 2015

(65) Prior Publication Data

US 2017/0144320 A1 May 25, 2017

(51) Int. Cl.

| | |
|---|---|
| ***B26D 5/12*** | (2006.01) |
| ***B21D 28/34*** | (2006.01) |
| ***B25F 5/00*** | (2006.01) |

(52) U.S. Cl.

CPC ..... *B26D 5/12* (2013.01); *B21D 28/34* (2013.01); *B21D 28/343* (2013.01); *B25F 5/005* (2013.01)

(58) Field of Classification Search

CPC .... B21D 28/343; B21D 28/34; B21D 28/346; B21D 28/36; B21D 28/26; B21D 28/002; B26F 1/386; B26F 1/34; B26F 1/32; B26F 1/40; B25F 5/005; Y10T 83/9423; Y10T 83/9425; Y10T 83/9428; Y10T 83/9435; Y10T 83/8864; B30B 1/007; B30B 1/32; B30B 1/323; B30B 1/326; B30B 1/08; B26D 5/12; F04B 39/02

USPC ..... 30/358, 360, 361, 362, 134, 180, 228; 100/94, 98 A, 98 R, 269.05, 269.19, 271; 72/453.01–453.04, 432, 437

See application file for complete search history.

(56) References Cited

U.S. PATENT DOCUMENTS

| | | | | |
|---|---|---|---|---|
| 3,269,011 | A * | 8/1966 | Herrstrum ..... | B21D 28/343 30/360 |
| 3,344,519 | A | 10/1967 | Goodman | |
| 4,392,263 | A | 7/1983 | Amoroso | |
| 4,516,748 | A | 5/1985 | Nix et al. | |

(Continued)

FOREIGN PATENT DOCUMENTS

| | | |
|---|---|---|
| DE | 20 2010 008228 | 11/2011 |

OTHER PUBLICATIONS

International Search Report and Written Opinion (ISR/WO); dated Oct. 6, 2016; PCT/US16/42775; 12 pg.

(Continued)

*Primary Examiner* — Evan H Macfarlane

(74) *Attorney, Agent, or Firm* — Mark E. Bandy; Rankin Hill & Clark, LLP

(57) ABSTRACT

A punch tool for forming holes or apertures in workpieces. The tool includes a primary cylinder containing a movable ram and a secondary cylinder containing another movable ram. The primary and secondary cylinders are in hydraulic communication with each other. The primary cylinder is releasably engageable with a powered press tool and various dies or punches can be attached at the secondary cylinder. Systems of powered tools and the punch tools, and methods of forming holes in workpieces using the punch tools.

30 Claims, 12 Drawing Sheets

(56) References Cited

U.S. PATENT DOCUMENTS

| | | | | |
|---|---|---|---|---|
| 4,922,615 | A * | 5/1990 | Nishida | B21D 28/24 30/360 |
| 5,125,324 | A | 6/1992 | Araki et al. | |
| 5,606,910 | A * | 3/1997 | Katz | B21D 28/002 100/208 |
| 6,065,326 | A | 5/2000 | Frenken | |
| 6,266,886 | B1 | 7/2001 | Tandart | |
| 6,532,790 | B2 | 3/2003 | Frenken | |
| 6,718,870 | B1 | 4/2004 | Frenken | |
| 6,772,521 | B2 | 8/2004 | Nordlin | |
| 7,797,840 | B2 | 9/2010 | Bublitz et al. | |
| 8,672,054 | B2 | 3/2014 | Frenken | |
| D706,602 | S | 6/2014 | Frenken | |
| 9,162,275 | B2 * | 10/2015 | Cheng | B21D 41/021 |
| 2008/0216543 | A1 * | 9/2008 | Hamm | B21D 39/04 72/352 |
| 2011/0297244 | A1 | 12/2011 | Zhang | |
| 2012/0255183 | A1 | 10/2012 | Myrhum, Jr. et al. | |
| 2012/0255184 | A1 | 10/2012 | Myrhum, Jr. et al. | |
| 2013/0202381 | A1 | 8/2013 | Frenken | |
| 2014/0251104 | A1 | 9/2014 | Frenken | |
| 2014/0260505 | A1 | 9/2014 | Bowles et al. | |

OTHER PUBLICATIONS

"Instruction Manual"; www.greenIee.com; 10 pages.
"Owner's Manual and Safety Instructions"; Pittsburgh Automotive; Items 44899, 44900; 16 pages.
EESR dated Jan. 24, 2019; Application No. 16869009.7; 9 pages.

* cited by examiner

PUNCH TOOL SYSTEM

FIELD

The present subject matter relates to tools for forming holes in a variety of workpieces such as metal sheets, and particularly to a punch tool that can be engaged with a hydraulic press tool.

BACKGROUND

For the installation of electrical components, electrical contractors use tools for creating large round and square holes in electrical enclosures. These enclosures are usually fabricated from low carbon or stainless steel sheet metal. The tools used for this purpose are well known in the industry and typically require a drilled pilot hole and draw bolt inserted through the hole in order to apply a load to a cutting die, typically known as a knockout. The draw bolts and knockouts are generally standardized and interchangeable with various tools for delivering the required punching force.

A wide array of types and classes of tools can be used for forming holes in sheet materials. Relatively simple tools can be utilized which use the draw bolt or a similar member to apply a load and require a ratchet or end-wrench to actuate. Alternatively, hydraulic rams that are operated by a hand pump are known. Such rams are directly connected to a pump or remotely connected using a hose. Alternatively, battery powered micro-hydraulic tools are known which utilize an integrated hydraulic ram, pump, and motor. Still other types of tools are known such as handheld powered tools that can be engaged with punch heads.

Although satisfactory in many respects, limitations exist with currently available tools. Punching tools are generally dedicated to a particular punching application. Thus, multiple tools are needed for different applications on a jobsite, such as for example cutting, crimping, etc. This imposes additional costs to the user. Punching tools are generally dedicated to only a specific size range of knockouts. The size range directly impacts the required output force of the tool. Thus, multiple tools may be needed for different punching operations to complete a single job. Manual devices require substantial user effort and time to complete a punch. Battery powered devices reduce the effort and time needed to make a punch, but also require greater space. Thus, battery powered devices may not be useable in limited space applications. Even if a battery powered device can be used in a particular application, there is typically reduced access to the areas surrounding the enclosure(s) where additional operations may need to be performed. Battery powered tools are also higher cost than manual options.

Accordingly, a need remains for tools and tool systems that address many if not all of these deficiencies, and which provide greater flexibility and ease of use for an operator.

SUMMARY

The difficulties and drawbacks associated with previous approaches are addressed in the present subject matter as follows.

In one aspect, the present subject matter provides a hydraulic punch tool comprising a nonpowered master cylinder including a linearly displaceable first ram movably disposed within a first chamber. The punch tool also comprises a slave cylinder including a linearly displaceable second ram movably disposed within a second chamber. The slave cylinder further includes provisions for releasably engaging a punch tool work head. The punch tool also comprises a rigid support arm extending between the master cylinder and the slave cylinder. The support arm provides hydraulic fluid communication between the first chamber of the master cylinder and the second chamber of the slave cylinder. Linear displacement of the first ram within the first chamber results in linear displacement of the second ram within the second chamber. The slave cylinder is pivotally positionable relative to the master cylinder so that an extension axis of the second ram of the slave cylinder can be oriented parallel with an extension axis of the first ram of the master cylinder.

In another aspect, the present subject matter provides a hydraulic tool system comprising a hydraulic punch tool including (i) a nonpowered master cylinder having a linearly displaceable first ram movably disposed within a first chamber, (ii) a slave cylinder having a linearly displaceable second ram movably disposed within a second chamber, the slave cylinder further having provisions for releasably engaging a punch tool work head, and (iii) a rigid support arm extending between the master cylinder and the slave cylinder, the support arm providing hydraulic fluid communication between the first chamber of the master cylinder and the second chamber of the slave cylinder. Linear displacement of the first rare within the first chamber results in linear displacement of the second ram within the second chamber. The slave cylinder is pivotally positionable relative to the master cylinder so that an extension axis of the second ram of the slave cylinder can be oriented parallel with an extension axis of the first ram of the master cylinder. The tool system also comprises a powered tool including an extendable member. At least one of the hydraulic punch tool and the powered tool include provisions for releasably engaging the hydraulic punch tool with the powered tool.

In yet another aspect, the present subject matter provides a method of forming an aperture in sheeted material. The method comprises providing a powered tool including an extendable member. The method also comprises providing a hydraulic punch tool including (i) a nonpowered master cylinder having a linearly displaceable first ram movably disposed within a first chamber, (ii) a slave cylinder having a linearly displaceable second ram movably disposed within a second chamber, the slave cylinder further having provisions for releasably engaging a punch tool work head, and (iii) a rigid support arm extending between the master cylinder and the slave cylinder, the support arm providing hydraulic fluid communication between the first chamber of the master cylinder and the second chamber of the slave cylinder. Linear displacement of the first ram within the first chamber results in linear displacement of the second ram within the second chamber. The slave cylinder is pivotally positionable relative to the master cylinder so that an extension axis of the second ram of the slave cylinder can be oriented parallel with an extension axis of the first ram of the master cylinder. The method also comprises providing provisions for forming an aperture in the sheeted material. At least a portion of the provisions are engageable with the second ram of the punch tool. The method also comprises engaging the powered tool with the punch tool such that extension of the member of the powered tool results in extension of the second ram of the punch tool. The method also comprises positioning the sheeted material between the second ram of the punch tool and at least a portion of the provisions for forming the aperture. And, the method comprises actuating the powered tool and extending the member of the tool to thereby result in retraction of the second ram of the punch tool, whereby the portion of the provisions engageable with the second ram of the punch tool are urged against the sheeted material and form an aperture in the sheeted material.

In still another aspect, the present subject matter provides a hydraulic punch tool comprising a nonpowered master cylinder including a linearly displaceable first ram movably displaced within a first chamber. The punch tool also comprises a slave cylinder including a linearly displaceable second ram movably disposed within a second chamber. The slave cylinder further includes provisions for releasably engaging a punch tool work head. The slave cylinder defines an oil reservoir within the second chamber. The oil reservoir has a variable volume dependent upon a linear position of the second ram. The oil reservoir extends between an interior annular wall of the second chamber, and an opposing annular face region of the second ram. The punch tool also comprises hydraulic fluid communication provisions between the first chamber of the master cylinder and the second chamber of the slave cylinder. Linear displacement of the first ram within the first chamber results in linear displacement of the second ram within the second chamber. The punch tool also comprises biasing provisions urging the opposing annular face region of the second ram toward the interior annular wall of the second chamber. The punch tool also comprises hydraulic oil contained in the oil reservoir, wherein a sufficient amount of oil contained in the oil reservoir results in a distal face of the second ram being either (i) flush or substantially flush with, or (ii) recessed relative to a distal end face of the second chamber.

As will be realized, the subject matter described herein is capable of other and different embodiments and its several details are capable of modifications in various respects, all without departing from the claimed subject matter. According) y, the drawings and description are to be regarded as illustrative and not restrictive.

DETAILED DESCRIPTION OF THE EMBODIMENTS

The present subject matter relates to nonpowered punch tools for forming holes or apertures in workpieces such as sheet materials. The punch tools comprise a primary cylinder having a linearly displaceable ram disposed within a chamber defined in the primary cylinder, and a secondary cylinder having a linearly displaceable ram disposed within a chamber defined in the secondary cylinder. The secondary cylinder is moveable relative to the primary cylinder. The chamber of the primary cylinder is in hydraulic communication with the chamber of the secondary cylinder such that linear displacement of either ram, results corresponding linear displacement of the other ram. The primary cylinder can be releasably engaged with a press tool or other device that provides a powered extension of a ram or other member. The press tool ram or member undergoing extension, displaces the ram of the primary cylinder which thereby results in displacement of the ram of the secondary cylinder. In many embodiments, the ram of the secondary cylinder includes provisions such as a die or punch which can be used to form openings, apertures, or holes in one or more workpieces. The movability or ability to selectively position one of the primary and secondary cylinders relative to the other, enables an expansive range of tool positions, orientations, and/or configurations. Such flexibility coupled with advantages associated with use of a powered tool increase ease of use for an operator.

Various embodiments of the punch tool are described. In certain embodiments, the primary and secondary cylinders are supportedly affixed or at least engaged to one another, while retaining their movability relative to one another. And in other embodiments, the primary and secondary cylinders are independently positionable relative to one another and a flexible conduit provides hydraulic fluid communication between the respective chambers. Additional aspects of these embodiments and others are described herein.

The present subject matter also relates to tool systems that include the punch tool in combination with a powered tool which includes an extendable member such as a hydraulic ram. The punch tool is releasably engageable with the powered tool.

Additionally, the present subject matter provides methods of forming holes or apertures in sheeted materials using the punch tools of the present subject matter.

These and other aspects of the present subject matter are described herein.

Figure 1:
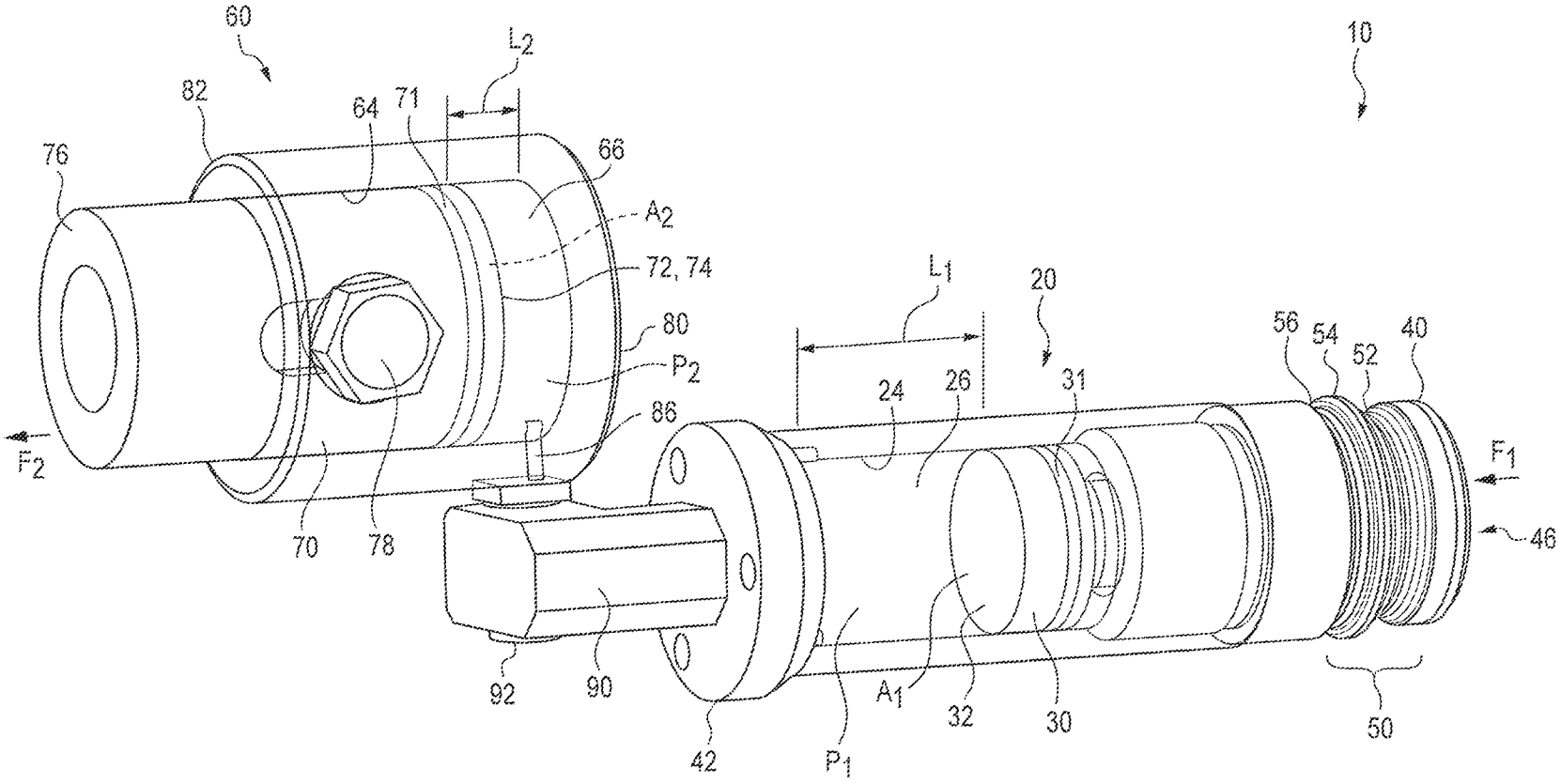
FIG. 1 is a schematic perspective view of a punch tool in accordance with an embodiment of the present subject matter.

FIG. 1 is a schematic view of a punch tool 10 in accordance with an embodiment of the present subject matter. The punch tool 10 comprises a primary cylinder 20 and a secondary cylinder 60 pivotally affixed to the primary cylinder 20. The primary cylinder 20 includes an inner cylinder wall 24 which defines a chamber 26. The primary cylinder 20 also includes a ram 30 movably disposed within the chamber 26. The ram 30 defines a ram face 32. The ram 30 includes one or more hydraulic seals 31. The primary cylinder 20 also defines a proximal end 40 and an opposite distal end 42. An inlet 46 or other opening is defined or accessible at the proximal end 40 of the primary cylinder 20. As described in greater detail herein, upon engagement of the primary cylinder 20 with a press tool (not shown in FIG. 1), the inlet 46 receives an extendable ram or drive member of the press tool which displaces the ram 30 of the primary cylinder 20. In certain versions of the punch tool 10, the provisions for releasably engaging the primary cylinder with a press tool are in the form of a quick connect system 50 as described in U.S. patent application Ser. No. 14/287,171 filed May 26, 2014. Generally, the quick connect system 50 includes a first circumferential groove 52 extending around the exterior of cylinder 20, a second circumferential groove 56 extending around the cylinder 20, and a circumferential ridge 54 extending around the cylinder 20 and disposed between the grooves 52 and 56. The first groove 52 is located closer to the proximal end 40 of the cylinder as compared to the second groove 56. In certain versions of the quick connect system 50, the width of the first groove 52 is greater than the width of the second groove 56. A corresponding assembly of biased spherical members sized to engage the first and second grooves is used in the receiving portion of the powered tool. A wide array of assemblies and provisions can be used. The releasable engagement provisions may be provided with either or both of the punch tool and the powered press tool.

The punch tool 10 also comprises the secondary cylinder 60. The secondary cylinder 60 includes an inner cylinder wall 64 which defines a chamber 66. The secondary cylinder 60 also includes a ram 70 movably disposed within the chamber 66. The ram 70 defines a ram face 72. The ram 70 includes one or more hydraulic seals 71. The secondary cylinder 60 also defines a proximal end 80 and an opposite distal end 82. A hydraulic fluid port 86 provides hydraulic communication between the chamber 66 of the secondary cylinder 60 and the chamber 26 of the primary cylinder 20.

The tool system 10 also comprises an engagement or support system between the primary and secondary cylinders 20, 60 respectively, which provides support and affixment and movement of one cylinder relative to another. Specifically, in the system 10, a support 90 extends from the primary cylinder 20 and particularly from the distal end 42 of the primary cylinder 20. A rotatable axle 92 is rotatably supported in the support 90 to which the secondary cylinder 60 is affixed.

Figure 2:
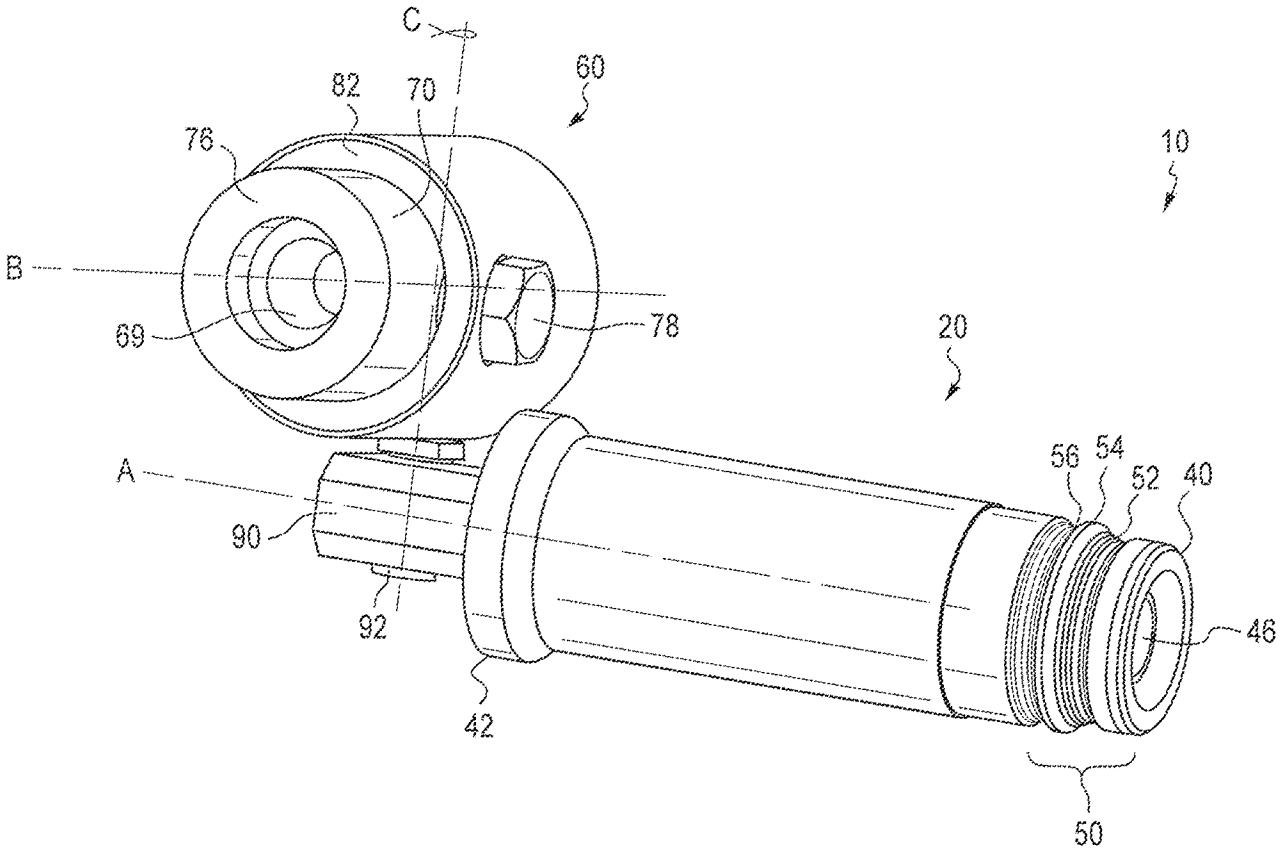
FIG. 2 is another schematic perspective view of the punch tool shown in FIG. 1.
Figure 3:
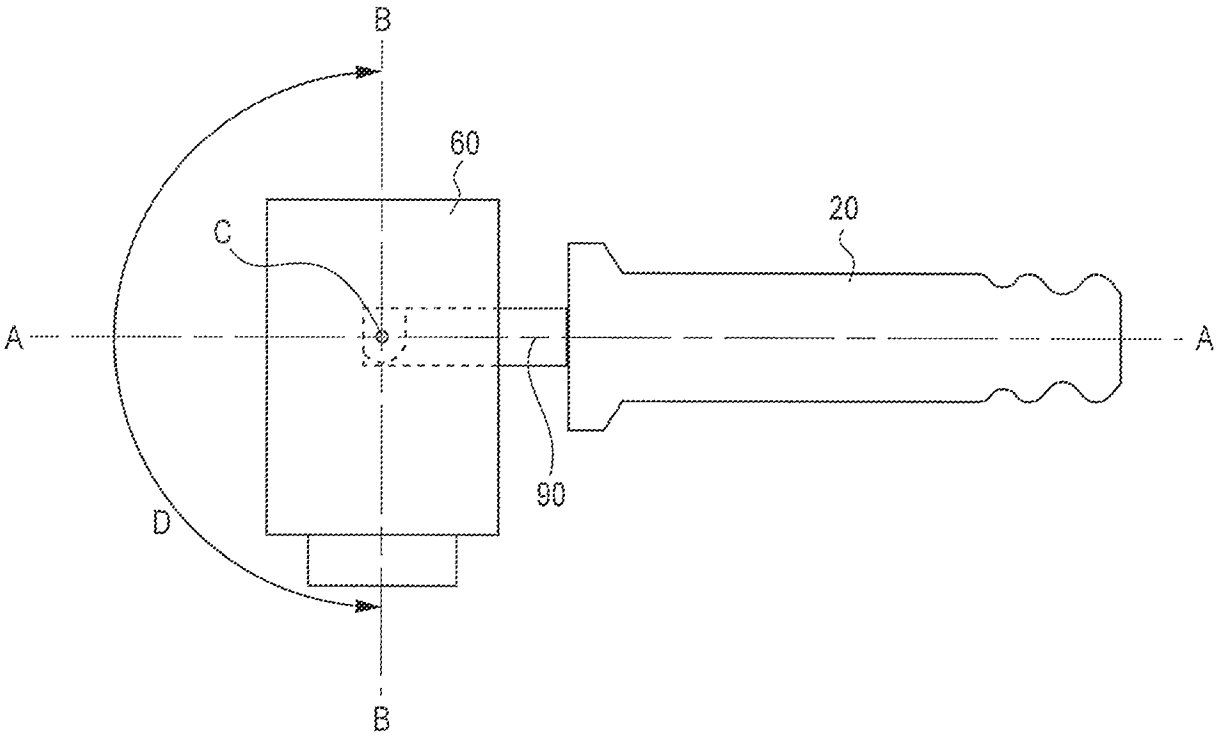
FIG. 3 is a schematic top view of the punch tool depicted in FIG. 2.

FIGS. 2 and 3 schematically depict the pivotal affixment of the primary and secondary cylinders 20, 60 of the punch tool 10. The figures illustrate a longitudinal axis A of the primary cylinder 20 and a longitudinal axis B of the secondary cylinder 60. The secondary cylinder 60 is rotatably affixed to the support 90 via the rotatable axle 92 such that the secondary cylinder 60 can be pivoted or rotated about axis C. Thus, the secondary cylinder 60 is pivotable or rotatable about axis C. In many versions of the punch tool 10, the axis C is transverse to the longitudinal axis A of the primary cylinder 20 and/or the longitudinal axis B of the secondary cylinder 60. Typically, the secondary cylinder 60 can be rotated about axis C through an arc D (see FIG. 3) of about 180°. However, it will be appreciated that the present subject matter includes tool systems in which arc D is less than 180°, and tool systems in which arc D is greater than 180° such as for example 270° or 360°.

Figure 4:
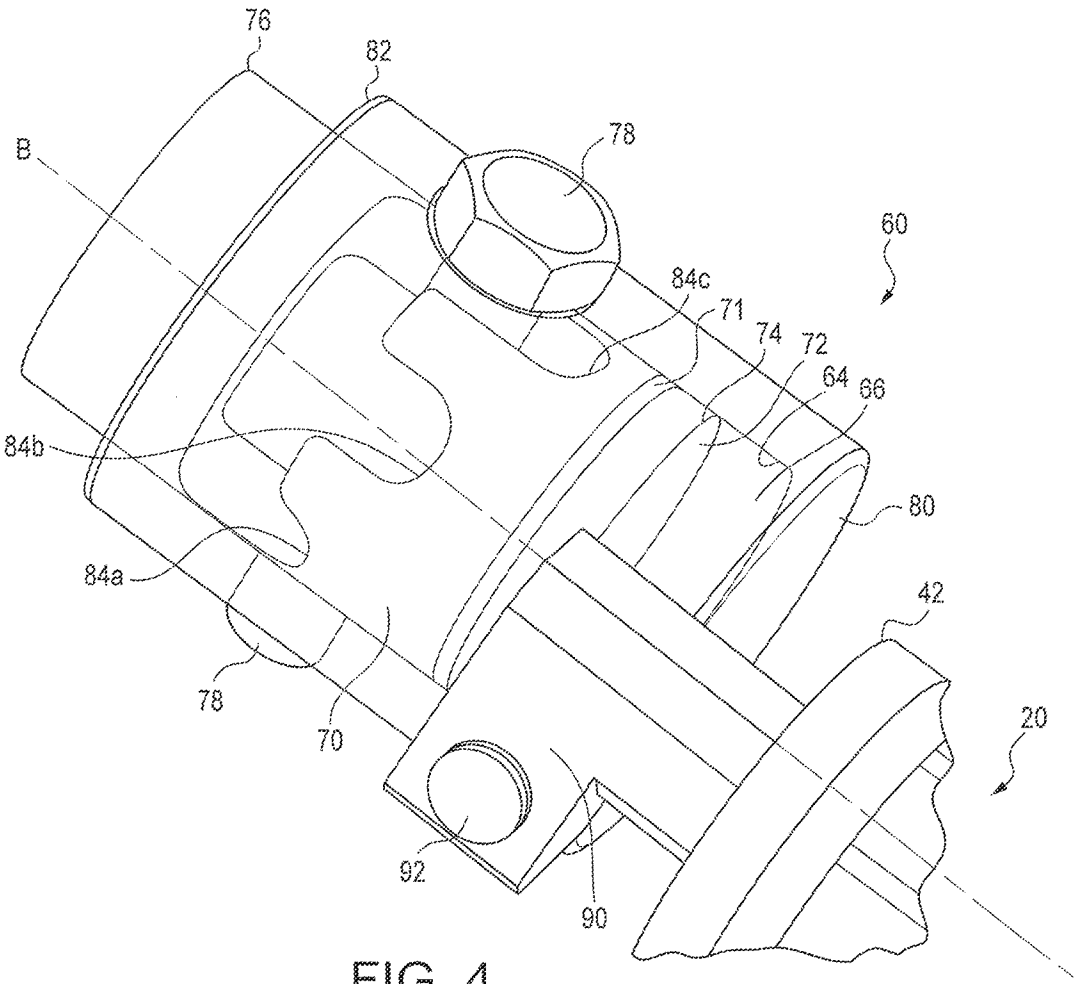
FIG. 4 is a detailed schematic view of a secondary cylinder of the punch tool of FIGS. 1-3.

FIG. 4 is a detailed schematic view of the secondary cylinder 60 and its components. As previously described, the secondary cylinder 60 includes a linearly displaceable ram 70 movably disposed within the chamber 66. The ram 70 defines a ram face 72 which may also be coextensive with a ram proximal end 74. The ram 70 also defines a ram distal end 76 generally opposite the ram proximal end 74. The secondary cylinder 60 also includes a stop member 78 and one or more receiving regions 84*a*, 84*b*, and/or 84*c* defined in the ram 70. The stop member 78 is affixed, integral with, or otherwise coupled with the wall of the secondary cylinder 60. The one or more receiving regions 84*a*, 84*b*, and/or 84*c* in the movable ram 70 are sized and shaped to receive, or at least contact, the stop member 78 upon sufficient displacement of the ram 70 from the proximal end 80 of the secondary cylinder 60. During use of the tool 10 and as described hi greater detail herein, displacement of the ram 70 beyond the distal end 82 of the secondary cylinder 60 occurs until contact occurs between the ram 70 and the stop member 78. In the particular version shown in FIG. 4, the ram 70 defines a first receiving region 84*a*, a second receiving region 84*b*, and third receiving region 84*c*. Typically, each receiving region includes a pair of walls and an arcuate end wall extending between the pair of walls. Each receiving region extends along a longitudinal span of the ram 70 to a different location or "depth" along the ram. Thus, upon selection of a particular receiving region, e.g., 84*a*, 84*b*, or 84*c*, the ram is rotated about longitudinal axis B until the selected receiving region is aligned with the stop member 78. Then, upon extension of the ram 70 outward and beyond the distal end 82 of the secondary cylinder 80, the stop member 78 is received within and captured by the selected receiving region. Contact between the stop member 78 and the arcuate end wall of the selected receiving region, prevents further displacement of the ram 70 from the secondary cylinder 60. Use of one or more stop members in conjunction with one or more receiving regions in the ram of the secondary cylinder prevents accidental or unintended over-extension of the ram from the secondary cylinder. It is known in the art that over-extension of hydraulic punch tools can result in damage to dies. Thus, the stop member 78 serves to guide the ram 70 and stop the ram 70 from over extending. The previously described stop feature of the secondary cylinder can also be incorporated in the primary cylinder.

The secondary cylinder 60 includes provisions for forming holes or apertures in various workpieces such as sheet materials. Typically, the provisions include a punch and die, and an assembly for retaining the punch and die in proper positions with a workpiece prior to and during "punching" or other deformation of the workpiece. Generally, the retaining assembly includes a threaded member or "draw stud" or draw bolt which is threadedly engaged at one of its ends with the secondary cylinder such as along engagement region 69 shown in FIG. 2. The other end of the threaded member is inserted through a pilot hole or other initial opening in the workpiece and a punch is attached to the threaded member. Prior to insertion of the threaded member in the pilot hole of the workpiece, a die is positioned between the ram 70 of the secondary cylinder 60 and the workpiece. In many assemblies, the threaded member extends through the die. Upon actuation of the punch tool, the ram 70 is extended, thereby displacing the die against one face of the workpiece. The punch contacts an opposite face of the workpiece, and thus upon further extension of the ram 70, the die is displaced toward the punch thereby forming a hole as desired in the workpiece.

Figure 5:
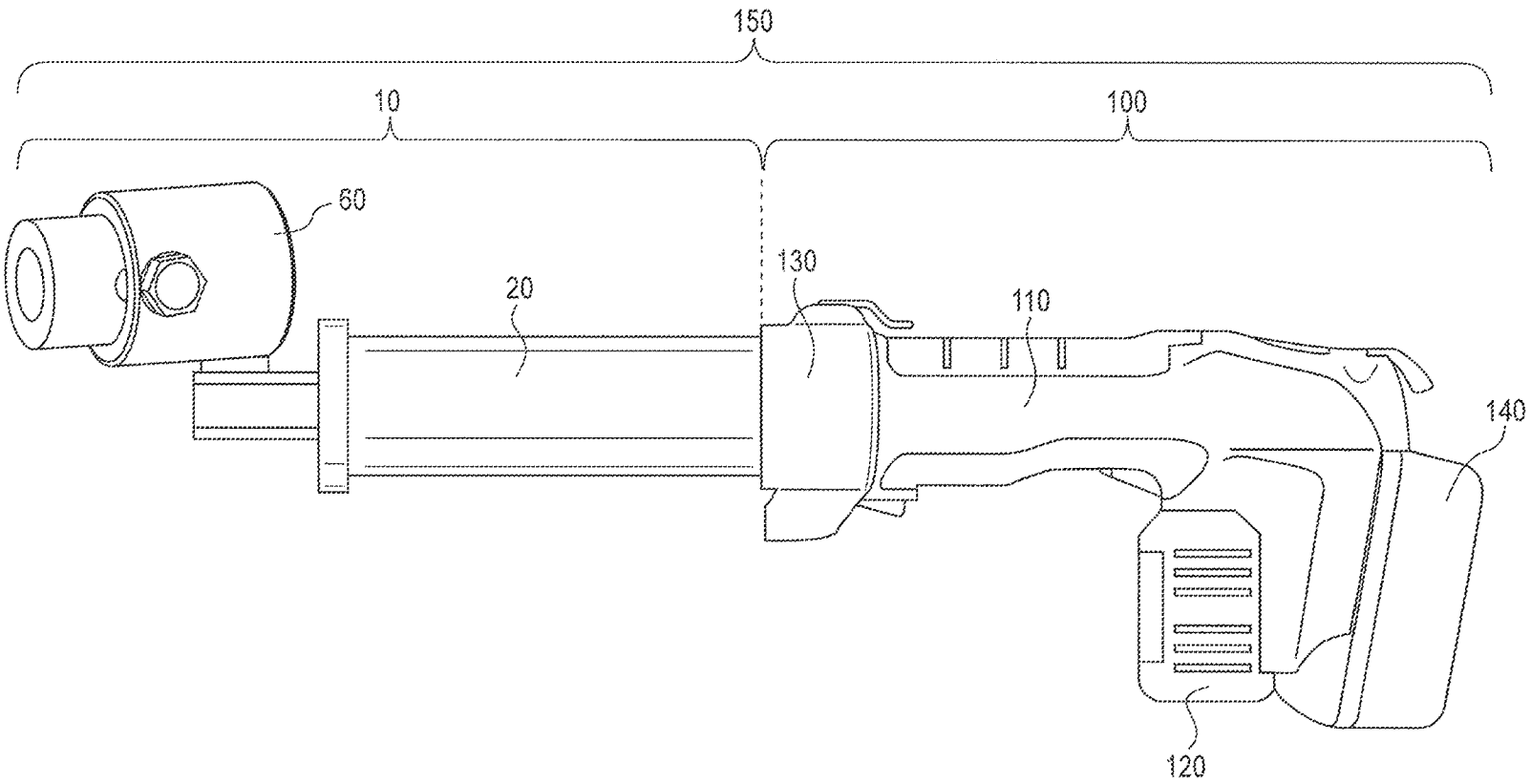
FIG. 5 is a schematic side view of the punch tool of FIGS. 1-4 engaged with a hydraulic press tool.

FIG. 5 illustrates a system 150 in which the punch tool 10 is releasably engaged with a powered tool and particularly a hydraulic press tool 100. It will be understood that the press tool 100 depicted in FIG. 5 is a representative example and that a wide array of powered tools having extendable rams or members may be engaged with the punch tools of the present subject matter. The hydraulic press tool 100 shown in FIG. 5 includes a body 110, a handle 120, a lose 130, and an optional battery pack 140. In the particular tool 100 depicted in FIG. 5, the tool includes a hydraulic ram which is extended from the nose 130 of the tool upon operator actuation of an electric motor enclosed within the body 110. The hydraulic ram (not shown) of the tool 100 extends within the previously described inlet 46 of the primary cylinder 20 best shown in FIG. 2. An example of a commercially available press tool which can be used as the press tool 100 is a RIDGID RE60 Press Tool. It will be understood however, that the present subject matter includes the use of a wide variety of tools and is not limited to press tools nor the specific RE60 Press Tool.

Figure 6:
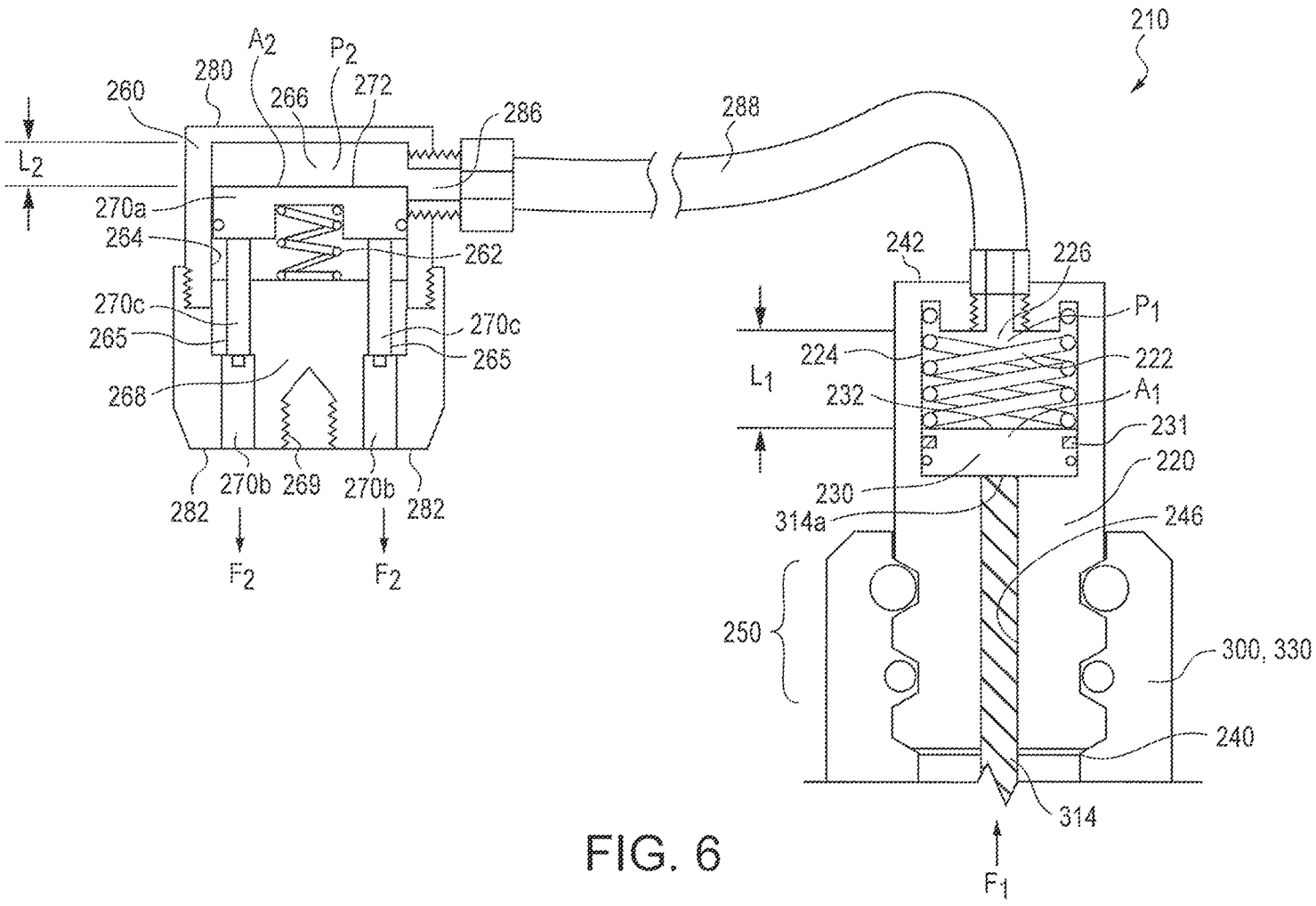
FIG. 6 is a schematic view illustrating various components and operation of another embodiment of a punch tool in accordance with the present subject matter.

FIG. 6 is a schematic illustration of another nonpowered punch tool 210 in accordance with another embodiment of the present subject matter. The punch tool 210 comprises a primary cylinder 220 and a secondary cylinder 260 coupled to the primary cylinder 220, yet moveable and independently positionable therewith. The primary cylinder 220 includes an inner cylinder wall 224 which defines a chamber 226. The primary cylinder 220 also includes a ram 230 movably disposed within the chamber 226. The ram 230 defines a ram face 232. The ram 230 includes one or more hydraulic seals 231. The primary cylinder 220 also defines a proximal end 240 and an opposite distal end 242. An inlet 246 or other opening is defined or accessible at the proximal end 240 of the primary cylinder 220. As will be understood, the inlet 246 receives a hydraulic ram or drive member of a press tool. In certain versions of the punch tool 210, the provisions for releasably engaging the primary cylinder 220 with a press tool are in the form of a quick connect system 250, such as previously described in conjunction with the quick connect system 50 of the punch 10. FIG. 6 schematically shows releasable engagement between the primary cylinder 220 and a nose end 330 of a press tool 300 having a powered extendable ram 314. Upon engagement and during use of the tool 210, the distal end 314*a* of the powered extendable ram 314 is in contact and engages the ram 230 of the primary cylinder 220.

The punch tool 210 also comprises a secondary cylinder 260. The secondary cylinder 260 includes an inner cylinder wall 264 which defines a chamber 266. The secondary cylinder 260 also includes a ram 270*a* movably disposed within the chamber 266. The ram 270*a* defines a ram face 272. The secondary cylinder 260 also defines a proximal end 280 and an opposite distal end 282. A flexible conduit 288 provides hydraulic communication between an inlet 286 and/or the chamber 266 of the secondary cylinder 260 and the chamber 226 of the primary cylinder 220.

The various punch tools of the present subject matter may also comprise one or more additional components and/or feature one or more additional aspects as follows. The punch tools may include biasing components in one or both of the primary and secondary cylinders that urge or bias a ram toward a particular position or direction within the cylinder. For example, referring to FIG. 6, the primary cylinder 220 includes a biasing member 222 which urges the ram 230 toward the proximal end 240 of the cylinder 220. The biasing member 222 can be for example a compression spring. However, it will be appreciated that tension spring(s) and/or other biasing assemblies could be used. The secondary cylinder 260 can also include a biasing member 262 which urges the ram 270*a* or other components as described herein, to a desired position or direction in the secondary cylinder 260 such as for example toward a proximal end of that cylinder.

In many embodiments of the tool 210, only one of the cylinders includes a biasing member such as primary cylinder 220 having the biasing member 222 and the secondary cylinder 260 is free of biasing member(s) such as member 262. Alternatively, the secondary cylinder 260 may include a biasing member, e.g., 262, and the primary cylinder 220 can be free of biasing members such as 222.

FIG. 6 also schematically depicts a particular multicomponent ram assembly used for the ram of the secondary cylinder 260. The ram assembly includes an inner ram component 270*a*, an outer ram component 270*b*, and one or more members such as pins 270*c* extending between the components 270*a* and 270*b*. The outer ram component 270*b* is at least partially accessible along a distal end 282 of the secondary cylinder 260. The inner ram component 270*a* defines the ram face 272 and upon displacement of the component 270*a*, the pins 270*c* transfer the displacement to the outer component 270*b*. The secondary cylinder 260 can include a body member 268 which defines one or more apertures 265 sized and shaped to receive the pins 270*c*. The body member 268 can also define a threaded engagement region 269 for receipt of a threaded member such as a draw stud as previously described. This multicomponent ram assembly carp also be used for the ram of the primary cylinder.

As will be appreciated, in all punch tool embodiments, hydraulic fluid is contained in the chambers of the first and the second cylinders and in any passages or flow lines extending therebetween. The embodiments utilize a closed hydraulic system such that linear displacement of one ram results in a corresponding linear displacement of the other ram.

Figure 7:
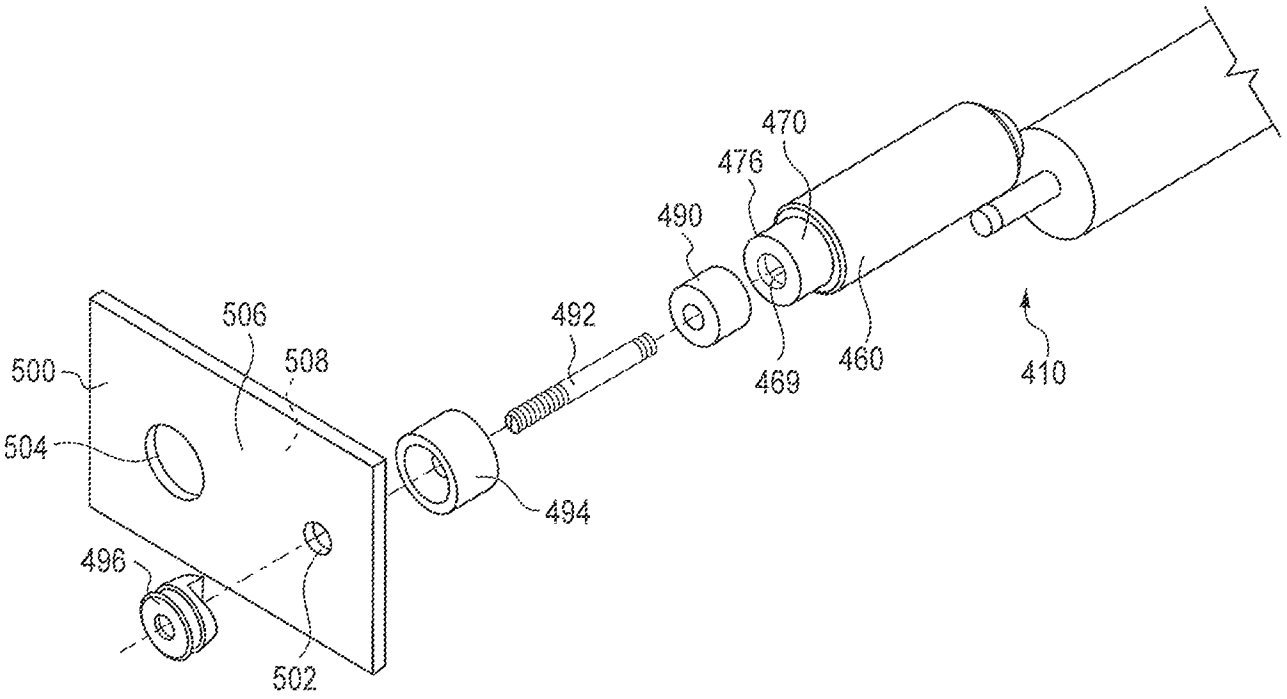
FIG. 7 is a schematic view illustrating use of the punch tool with aperture forming provisions and a sheeted material.

FIG. 7 is a schematic view illustrating a punch tool 410 in accordance with the present subject matter and provisions for forming apertures in sheeted material 500. The punch tool 410 is generally as previously described herein and includes a secondary cylinder 460 that includes an extendable second ram 470. The ram 470 defines a distal end 476 and a threaded engagement region 469. The punch tool 410 is releasably engaged with a powered tool (not shown) as described herein. The provisions for forming apertures include one or more optional spacers 490, a draw bolt 492, a die 494, and a punch 496. The workpiece such as sheeted material 500 defines a first face 506 and a second oppositely directed face 508. The second face 508 is directed toward the punch tool 410.

In order to form an aperture in the material 500, such as aperture 504, a pilot hole 502 is formed typically by drilling. The pilot hole 502 can range in size, and is typically from about 0.25 inch to about 1.0 inch. The pilot hole can be any shape so long as it permits insertion by the draw bolt.

The provisions for forming an aperture in the material 500 are arranged such that the draw bolt 492 is threadedly engaged with the engagement provisions 469 of the second ram 470 of the punch tool 410. The other end of the draw bolt 492 is inserted through the die 494 and the pilot hole 502 and engaged with the punch 496. Thus, as shown in FIG. 7, the punch 496 is positioned along the first face 506 of the material 500. And, the die 494 is positioned along the second face 508 of the material 500. If one or more spacers 490 are used, the spacer(s) 490 are positioned between the second face 508 of the material 500 and the punch tool 410, and the draw bolt 492 typically extends through the spacer(s).

It will be appreciated that the present subject matter includes variant assemblies, configurations, and arrangement of components and workpieces, and is not limited to the configuration shown in FIG. 7. For example, the apertures to be formed in the workpiece can have other shapes besides circular for example, oval, square, rectangular, triangular, polygonal, or other shape. The provisions may also include one or more adapters, engagement components such as threaded nuts, and the like.

Another aspect of the various punch tools of the present subject matter relates to significantly increased punch forces which can be produced at the secondary cylinder as a result of force multiplication. Referring to FIG. 1 for example, the force $F_2$ produced during extension of the ram 70 of the secondary cylinder 60 is a function of the surface area $A_2$ of the ram 70 and the pressure $P_2$ of the hydraulic fluid within the chamber 66. Similarly, referring to FIG. 6 for example, the force $F_2$ produced during extension of the ram 270*a* of the secondary cylinder 260 is a function of the surface area $A_2$ of the ram 270*a* and the pressure $P_2$ of the hydraulic fluid within the chamber 266. Because the hydraulic system is closed, hydraulic pressure within the primary and secondary cylinders will be the same or substantially the same, i.e., $P_1=P_2$. Because any change in volume of one cylinder is equal to a change in volume of the other cylinder, the relationship between the surface areas of the rams is as follows:

$$A_1 \cdot L_1 = A_2 \cdot L_2$$

The force $F_1$ exerted by a powered ram upon the ram of the primary cylinder is transferred through the pressure of the hydraulic fluid within the system to the ram of the secondary cylinder. Thus, the force $F_2$ produced at the secondary cylinder is a function of the force $F_1$ exerted upon the primary cylinder by the powered ram, and is proportional to the ratio of surface areas of the rams:

$$F_2 = F_1\left(\frac{A_1}{A_2}\right)$$

Thus, upon engagement of the punch tool to a powered ram such as a hydraulic press tool, the ram of the secondary cylinder of the punch tool can produce a force that is greater than the extension force produced by the ram of the press tool. For the systems described herein, the force produced by the ram of the secondary cylinder is equal or substantially equal to the force produced by the powered ram multiplied by the ratio of the surface areas of the primary ram to the secondary ram, $A_1:A_2$.

Figure 8:
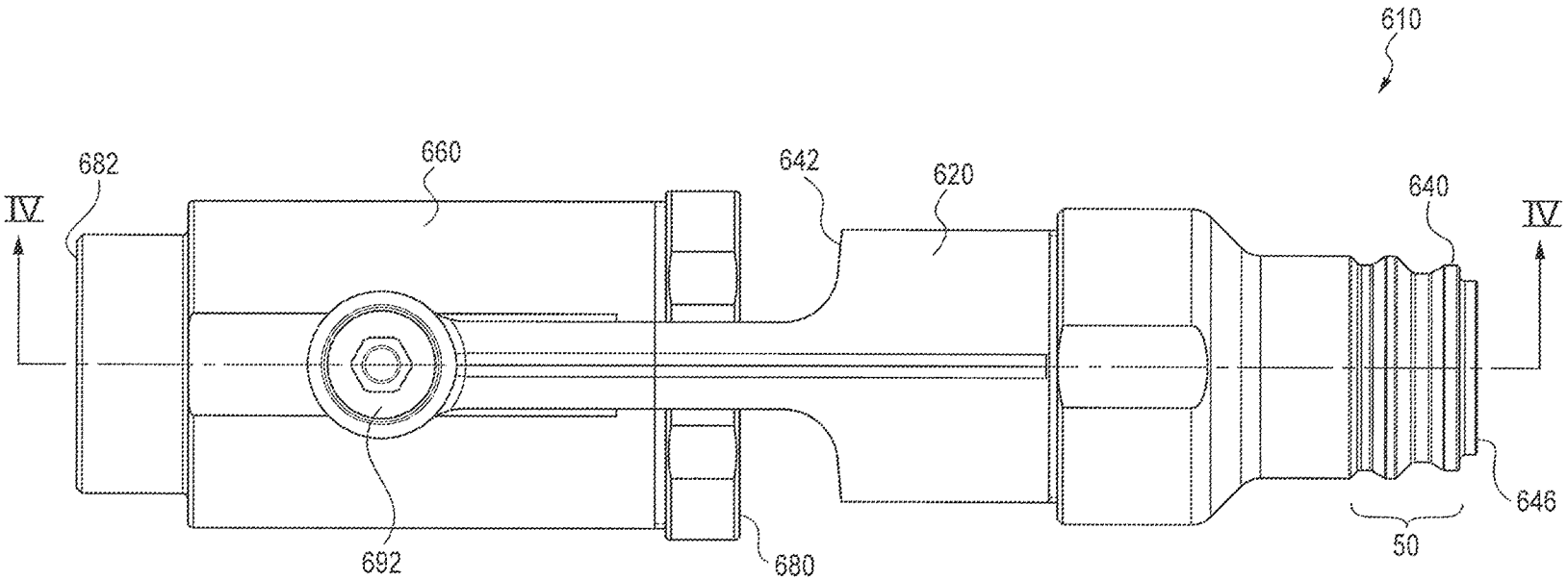
FIG. 8 is a schematic top view of another embodiment of a punch tool in accordance with the present subject matter.
Figure 9:
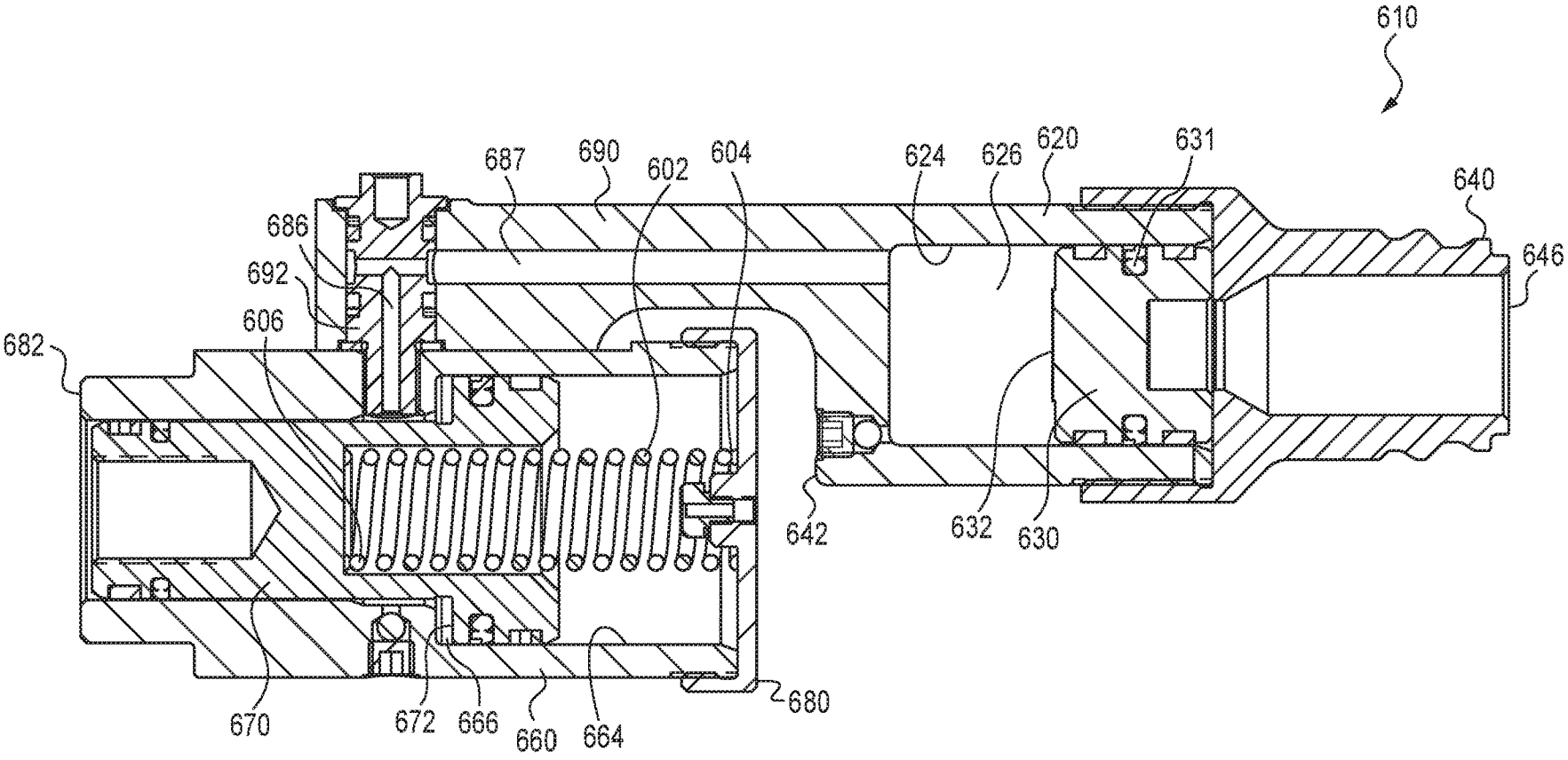
FIG. 9 is a cross sectional view of the punch tool depicted in FIG. 8, taken across line IX-IX.
Figure 10:
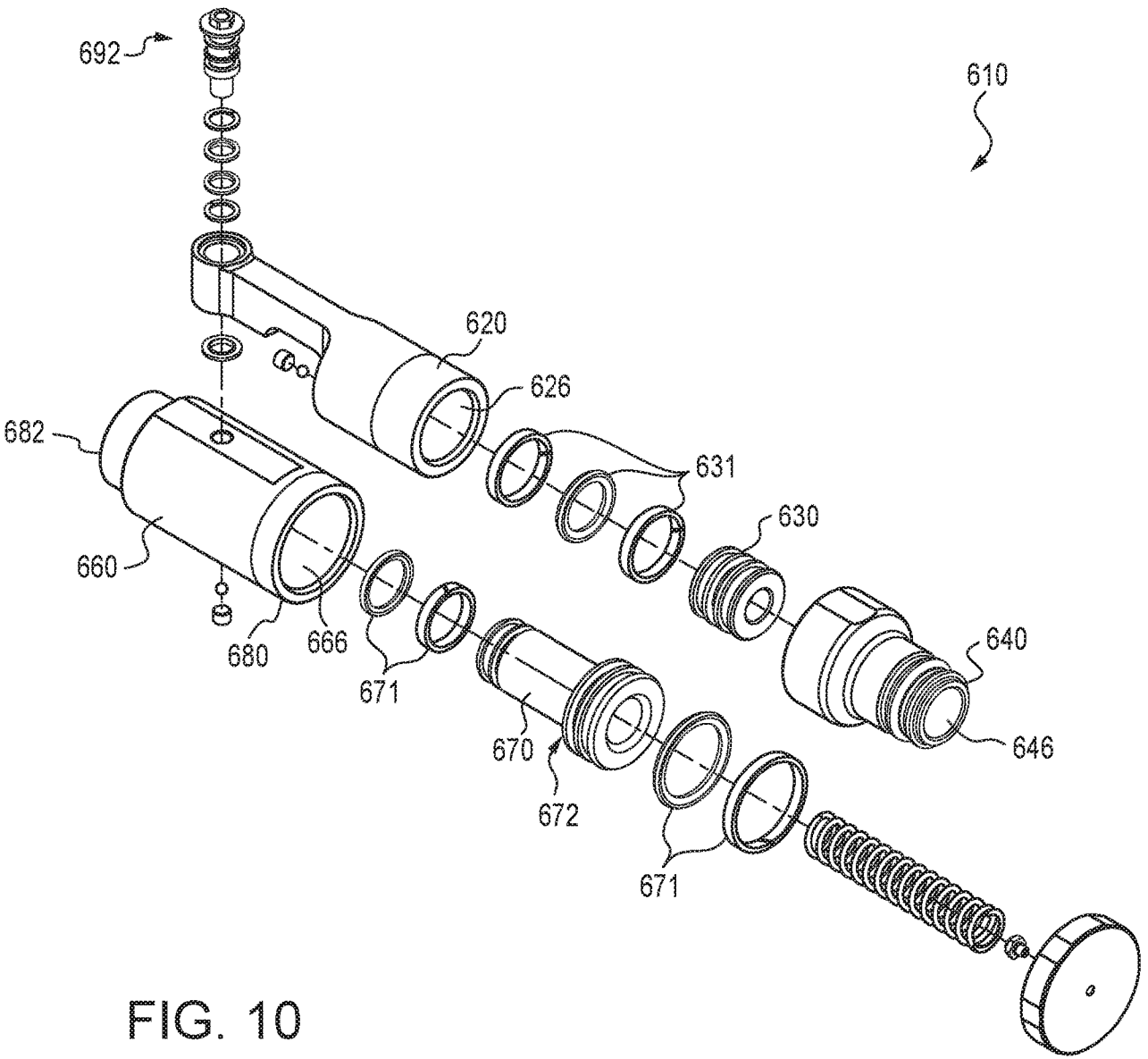
FIG. 10 is an exploded schematic view of the punch tool shown in FIGS. 8-9.

FIGS. 8-10 are a schematic views of a punch tool 610 in accordance with another embodiment of the present subject matter. The punch tool 610 comprises a primary cylinder 620 and a secondary cylinder 660 pivotally affixed to the primary cylinder 620. The primary cylinder 620 includes an inner cylinder wall 624 which defines a chamber 626. The primary cylinder 620 also includes a ram 630 movably disposed within the chamber 626. The ram 630 defines a ram face 632. The ram 630 includes one or more hydraulic seals 631. The primary cylinder 620 also defines a proximal end 640 and an opposite distal end 642. An inlet 646 or other opening is defined or accessible at the proximal end 640 of the primary cylinder 620. As described in greater detail herein, upon engagement of the primary cylinder 620 with a press tool (not shown in FIGS. 8-10), the inlet 646 receives an extendable ram or drive member of the press tool which displaces the ram 630 of the primary cylinder 620. In certain versions of the punch tool 610, the provisions for releasably engaging the primary cylinder with a press tool are in the form of the previously described quick connect system 50 as described in U.S. patent application Ser. No. 14/287,171 filed May 26, 2014. A wide array of assemblies and provisions can be used. The releasable engagement provisions may be provided with either or both of the punch tool and the powered press tool.

The punch tool 610 also comprises the secondary cylinder 660. The secondary cylinder 660 includes an inner cylinder wall 664 which defines a chamber 666. The secondary cylinder 660 also includes a ram 670 movably disposed within the chamber 666. The ram 670 defines a ram face 672. The ram 670 includes one or more hydraulic seals 671. The secondary cylinder 660 also defines a proximal end 680 and an opposite distal end 682. A hydraulic fluid port 686 provides hydraulic communication between the chamber 666 of the secondary cylinder 660 and the chamber 626 of the primary cylinder 620 or a conduit 687 described herein.

The tool system 610 also comprises an engagement or support system between the primary and secondary cylinders 620, 660 respectively, which provides support and affixment and movement of one cylinder relative to another. Specifically, in the system 610, a support 690 extends from the primary cylinder 620 and particularly from the distal end 642 of the primary cylinder 620. A rotatable axle 692 is rotatably supported in the support 690 to which the secondary cylinder 660 is affixed. The support 690 defines one or more conduit(s) or fluid passageway(s) 687 for providing fluid communication between the chamber 626 and the fluid port 686.

The punch tool 610 also comprises biasing members such as a coil spring 602 having proximal and distal ends 604, 606, respectively. The spring 602 is disposed in the secondary cylinder 660 and urges the ram 670 toward the distal end 682 of the secondary cylinder 660. It will be appreciated that a wide array of biasing members can be used and thus the present subject matter is not limited to the use of coil spring 602 to urge the ram 670 as described.

Many or all of the features and details of the punch tool 10 described herein can be incorporated in the punch tool 610 depicted in FIGS. 8-9.

Figure 11:
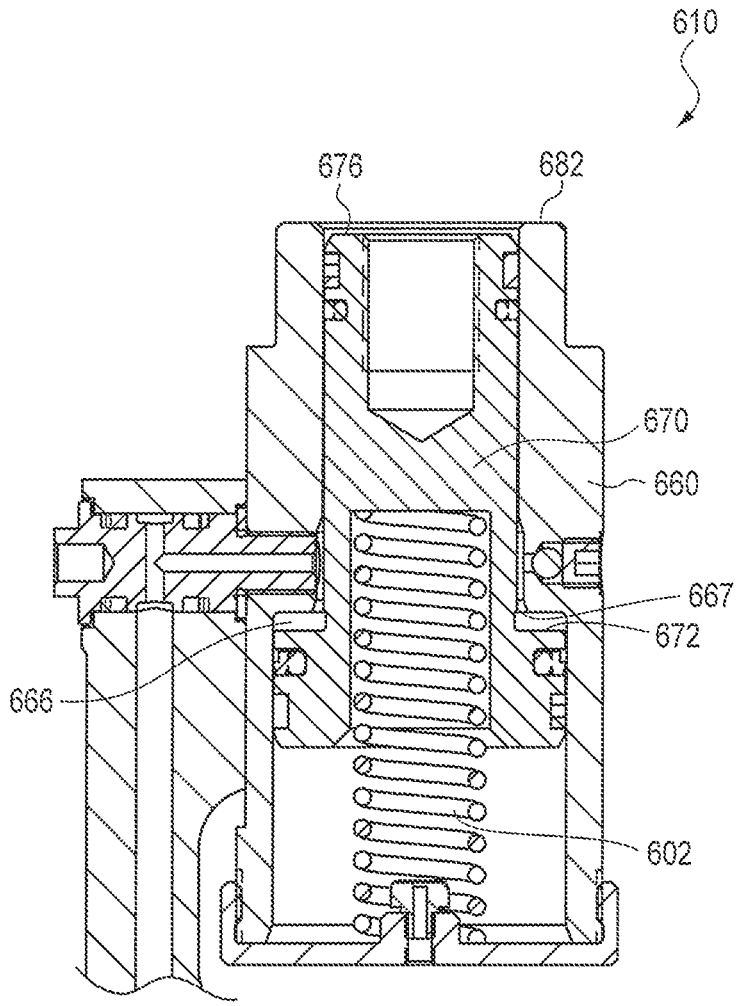
FIGS. 11-12 illustrate a low oil Indication feature that can be incorporated in the punch tools of the present subject matter.
Figure 12:
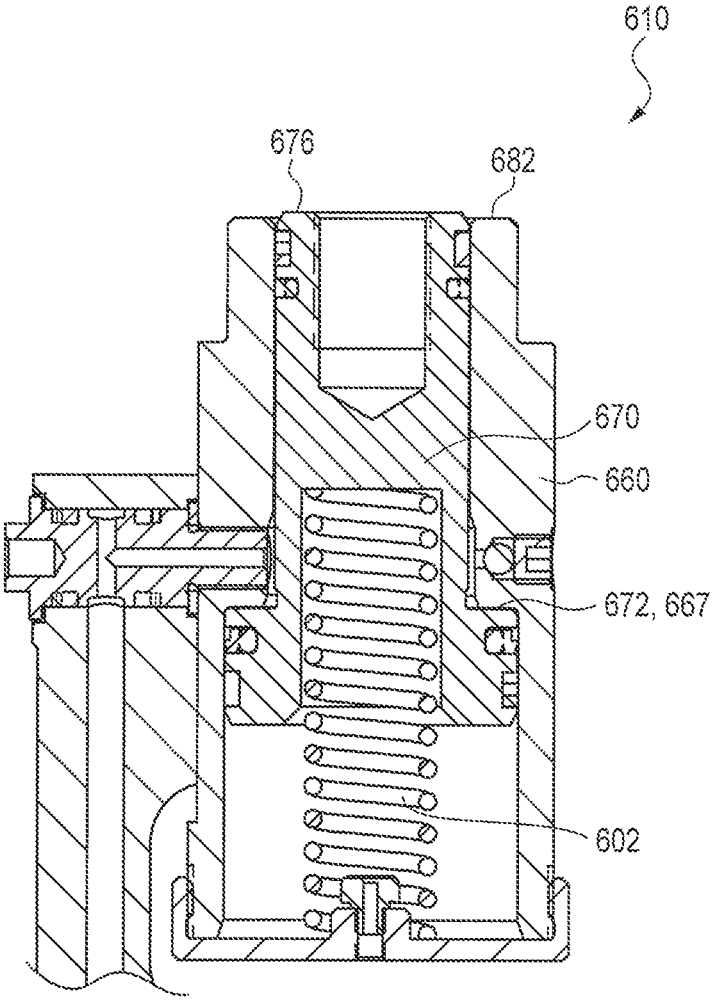

FIGS. 11 and 12 illustrate a "low oil indicator" feature that can be included in the punch tools of the present subject matter. FIGS. 11 and 12 illustrate the use and/or incorporation of the low oil indicator feature in the secondary cylinder 660 of the punch tool 610 shown in FIGS. 8-10, and the secondary ram 670 disposed therein. The ram 670 defines the ram face 672 and a distal end 676.

Specifically, FIG. 11 illustrates the punch tool 610 at a state of proper or sufficient oil fill in the hydraulic system. At this state or condition, the distal end 676 of the ram 670 does not extend beyond the distal end 682 of the secondary cylinder 660. In many embodiments, the distal end 682 of the cylinder 660 is flush or substantially flush with the distal end 676 of the ram 670. Alternatively, in many embodiments, the distal end 682 of the cylinder 660 extends beyond the distal end 676 of the ram 670. Thus, the distal end 676 of the ram 670 is recessed relative to the distal end 682 of the cylinder 660. A relatively small volume of oil is disposed between the ram face 672 and a stop face 667 defined in the chamber 666 of the secondary cylinder 660 when the ram 670 reaches its "home" position as a result of biasing by spring 602, corresponding to a fully retracted position relative to the cylinder 660.

FIG. 12 illustrates a low oil condition which could result from a leak or an improperly filled hydraulic system for example. In this state or condition, the distal end 676 of the ram 670 extends or protrudes beyond the distal end 682 of the secondary cylinder 660. In a leakage situation, as the tool leaks, the oil reserved in the chamber 666 is depleted or substantially so. Eventually this causes the distal end 676 of the ram 670 to extend beyond the distal end 682 of the cylinder 660 when the ram 670 is in its home position. This occurs as a result of the spring 602 urging the ram 670 toward the distal end 682 of the cylinder 660.

Many other benefits will no doubt become apparent in future application and development of this technology.

All patents, patent applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A hydraulic punch tool comprising:

a master cylinder including a linearly displaceable first ram movably disposed within a first chamber, the master cylinder defining a proximal end and an opposite distal end;

a slave cylinder including a linearly displaceable second ram movably disposed within a second chamber, the slave cylinder further including provisions for releasably engaging a punch tool work head;

a rigid support arm extending between the distal end of the master cylinder and the slave cylinder, the support arm providing hydraulic fluid communication between the first chamber of the master cylinder and the second chamber of the slave cylinder, wherein linear displacement of the first ram within the first chamber results in linear displacement of the second ram within the second chamber;

wherein the slave cylinder is pivotally positionable relative to the master cylinder so that an extension axis of the second ram of the slave cylinder can be oriented parallel with an extension axis of the first ram of the master cylinder, wherein the master cylinder further includes provisions for releasably engaging a powered press tool, wherein the chamber of the master cylinder is in hydraulic communication with the chamber of the slave cylinder such that linear displacement of the first ram results in a corresponding linear displacement of the second ram;

wherein linear displacement of the second ram toward the first ram produces a linear displacement of the first ram.

2. The hydraulic punch tool of claim 1 wherein the second ram is linearly displaceable between a fully extended position and a fully retracted position, the slave cylinder further including biasing provisions urging the second ram to one of the fully extended position and the fully retracted position.

3. The hydraulic punch tool of claim 1 wherein the provisions for releasably engaging a powered press tool include a first exterior circumferential groove defined in the master cylinder, a second exterior circumferential groove defined in the master cylinder, and an exterior circumferential ridge defined in the master cylinder between the first groove and the second groove.

4. The hydraulic punch tool of claim 3 wherein a width of the first groove is greater than a width of the second groove.

5. The hydraulic punch tool of claim 4 wherein a first distance between the first groove and the proximal end of the master cylinder is less than a second distance between second groove and the proximal end of the master cylinder.

6. The hydraulic punch tool of claim 1 wherein the slave cylinder is pivotally positionable about a pivot axis that is oriented at right angles to the extension axis of the first ram of the master cylinder.

7. The hydraulic punch tool of claim 6 wherein the slave cylinder is pivotally positionable to all locations within a 360° range about the pivot axis.

8. The hydraulic punch tool of claim 1 wherein the slave cylinder is pivotally positionable about a pivot axis that is oriented at right angles to the extension axis of the second ram of the slave cylinder.

9. The hydraulic punch tool of claim 8 wherein the slave cylinder is pivotally positionable to all locations within a 360° range about the pivot axis.

10. The hydraulic punch tool of claim 1 wherein the support arm defines a fluid pathway which provides the hydraulic fluid communication, the fluid pathway defining a longitudinal axis, wherein the support arm is positioned relative to the master cylinder such that the longitudinal axis is parallel to the extension axis of the first ram of the master cylinder.

11. The hydraulic punch tool of claim 1 wherein the slave cylinder is movable into a position where the extension axis of the second ram of the slave cylinder is non-parallel with the extension axis of the first ram of the master cylinder.

12. The hydraulic punch tool of claim 1 wherein the slave cylinder defines an oil reservoir within the second chamber, the oil reservoir having a variable volume dependent upon a linear position of the second ram, the oil reservoir extending between an interior annular wall of the second chamber and an opposing annular face region of the second ram.

13. The hydraulic punch tool of claim 12 further comprising:

biasing provisions urging the opposing annular face region of the second ram toward the interior annular wall of the second chamber.

14. The hydraulic punch tool of claim 13 further comprising:

hydraulic oil contained in the oil reservoir, wherein a sufficient amount of oil contained in the oil reservoir results in a distal face of the second ram being either (i) flush with, or (ii) recessed relative to a distal end face of the second chamber.

15. The hydraulic punch tool of claim 13 wherein a deficient amount of oil contained in the oil reservoir results in a distal face of the second ram projecting outwardly beyond a distal end face of the second chamber.

16. A hydraulic tool system comprising:

a hydraulic punch tool including (i) a master cylinder having a linearly displaceable first ram movably disposed within a first chamber, (ii) a slave cylinder having a linearly displaceable second ram movably disposed within a second chamber, the slave cylinder further having provisions for releasably engaging a punch tool work head, and (iii) a rigid support arm extending between the master cylinder and the slave cylinder, the support arm providing hydraulic fluid communication between the first chamber of the master cylinder and the second chamber of the slave cylinder, wherein linear displacement of the first ram within the first chamber results in linear displacement of the second ram within the second chamber, and wherein the slave cylinder is pivotally positionable relative to the master cylinder so that an extension axis of the second ram of the slave cylinder can be oriented parallel with an extension axis of the first ram of the master cylinder;

a powered tool including an extendable member, an electric motor, and a battery pack;

wherein at least one of the hydraulic punch tool and the powered tool include provisions for releasably engaging the hydraulic punch tool with the powered tool, wherein the chamber of the master cylinder is in hydraulic communication with the chamber of the slave cylinder such that linear displacement of the first ram in either direction axially relative to the master cylinder results in a corresponding linear displacement of the second ram, and such that linear displacement of the second ram in either direction axially relative to the slave cylinder results in a corresponding linear displacement of the first ram.

17. The hydraulic tool system of claim 16 wherein the provisions for releasably engaging the hydraulic punch tool with the powered tool include a first exterior circumferential groove defined in the master cylinder, a second exterior circumferential groove defined in the master cylinder, and an exterior circumferential ridge defined in the master cylinder between the first groove and the second groove.

18. The hydraulic tool system of claim 17 wherein a width of the first groove is greater than a width of the second groove.

19. The hydraulic tool system of claim 18 wherein the first groove is located closer to a proximal end of the master cylinder than the second groove.

20. The hydraulic tool system of claim 16 wherein the second ram is linearly displaceable between a fully extended position and a fully retracted position, the slave cylinder further including biasing provisions urging the second ram to one of the fully extended position and the fully retracted position.

21. The hydraulic tool system of claim 16 wherein the slave cylinder is movable into a position where the extension axis of the second ram of the slave cylinder is non-parallel with the extension axis of the first ram of the master cylinder.

22. The hydraulic tool system of claim 16 wherein the slave cylinder is pivotally positionable about a pivot axis that is oriented at right angles to the extension axis of the first ram of the master cylinder.

23. The hydraulic tool system of claim 22 wherein the slave cylinder is pivotally positionable to all locations within a 360° range about the pivot axis.

24. The hydraulic tool system of claim 16 wherein the slave cylinder is pivotally positionable about a pivot axis that is oriented at right angles to the extension axis of the second ram of the slave cylinder.

25. The hydraulic tool system of claim 24 wherein the slave cylinder is pivotally positionable to all locations within a 360° range about the pivot axis.

26. The hydraulic tool system of claim 16 wherein the hydraulic punch tool defines an oil reservoir in the slave cylinder extending between an interior wall of the second chamber and an opposing face region of the second ram, the slave cylinder further having biasing provisions urging the opposing face region of the second ram toward the interior wall of the second chamber.

27. The hydraulic tool system of claim 26 wherein the hydraulic punch further includes oil contained in the oil reservoir and (i) a first amount of the oil contained in the oil reservoir results in a distal face of the second ram being either flush with or recessed relative to a distal end face of the second chamber, and (ii) a second amount of the oil contained in the reservoir less than the first amount, results in the distal face of the second ram projecting outwardly beyond the distal end face of the second chamber.

28. A hydraulic punch tool comprising:

a master cylinder defining a proximal end and an opposite distal end, the master cylinder including a linearly displaceable first ram movably displaced within a first chamber, and a biasing member that urges the first ram toward the proximal end of the master cylinder;

a slave cylinder including a linearly displaceable second ram movably disposed within a second chamber, the slave cylinder further including provisions for releasably engaging a punch tool work head, the slave cylinder defining an oil reservoir within the second chamber, the oil reservoir having a variable volume dependent upon a linear position of the second ram, the oil reservoir extending between an interior annular wall of the second chamber, and an opposing annular face region of the second ram;

hydraulic fluid communication provisions between the first chamber of the master cylinder and the second chamber of the slave cylinder, wherein linear displacement of the first ram within the first chamber results in linear displacement of the second ram within the second chamber;

biasing provisions urging the opposing annular face region of the second ram toward the interior annular wall of the second chamber;

hydraulic oil contained in the oil reservoir, wherein a sufficient amount of the oil contained in the oil reservoir results in a distal face of the second ram being either (i) flush with, or (ii) recessed relative to a distal end face of the second chamber, wherein the master cylinder further includes provisions for releasably engaging a powered press tool, wherein the chamber of the master cylinder is in hydraulic communication with the chamber of the slave cylinder such that linear displacement of the second ram toward the first ram results in linear displacement of the first ram away from the second ram.

29. The hydraulic punch tool of claim 28 wherein a deficient amount of the oil contained in the oil reservoir results in the distal face of the second ram projecting outwardly beyond the distal end face of the second chamber.

30. The hydraulic punch tool of claim 28 further comprising:

a rigid support arm extending between the master cylinder and the slave cylinder.

* * * * *